US005169007A

United States Patent [19]

McHendry

[11] Patent Number: 5,169,007

[45] Date of Patent: Dec. 8, 1992

[54] HAT HANGER

[76] Inventor: Donnie R. McHendry, Ste. 218, 601 S. Washington, Stillwater, Okla. 74074

[21] Appl. No.: 851,895

[22] Filed: Mar. 16, 1992

[51] Int. Cl.[5] ..... A47F 7/00

[52] U.S. Cl. ..... 211/32; 211/30; 211/119; 248/309.1

[58] Field of Search ..... 211/30, 32, 106, 119; 248/309.1, 302

[56] References Cited

U.S. PATENT DOCUMENTS

| | | | |
|---|---|---|---|
| 1,034,439 | 8/1912 | Fuskerud | 211/32 X |
| 3,208,597 | 9/1965 | Hansen | 211/32 |
| 4,583,646 | 4/1986 | Bowman | 211/32 |
| 5,033,660 | 7/1991 | Kelly | 211/30 X |

*Primary Examiner*—Robert W. Gibson, Jr.

*Attorney, Agent, or Firm*—Young & Thompson

[57] ABSTRACT

A hat hanger includes a hook and a crosspiece suspended by its middle from the hook. The crosspiece has ends from which depend a first pair of downwardly extending forward legs, and a second pair of downwardly extending rear legs are supported by the ends of the crosspiece and are disposed behind the first downwardly extending legs. These second downwardly extending legs have rearwardly extending bends intermediate their length and they terminate downwardly in a forwardly extending loop interconnecting lower ends of the second downwardly extending legs. The hook is swivelly connected to the crosspiece for horizontal swinging movement of the crosspiece relative to the hook. The first downwardly extending legs terminate downwardly in free ends that have enlarged protectors on them to protect a hat against damage from the free ends.

6 Claims, 1 Drawing Sheet

HAT HANGER

The present invention relates to a hat hanger, particularly for large hats such as western or cowboy hats.

As is well known, men's hats that are hung on hooks, particularly felt hats, become damaged or misshapen. This is particularly true of large hats such as western or cowboy hats, which become misshapen not only because of the pressure of the hook on the hat, but also because the large brim tends to bear against the wall that supports the hook, and this eventually causes the brim to become misshapen.

Hat hangers are already known, for example in U.S. Pat. No. 2,889,935, but their construction is difficult and they do not adequately keep a hat spaced from a wall on which it is hung.

It is accordingly an object of the present invention to provide a hat hanger, particularly for large hats such as western or cowboy hats, which will support the hat while preserving the desired shape of the hat.

Another object of the present invention is the provision of such a hat hanger, which will maintain all portions of the hat spaced from a wall on which the hanger is supported.

Finally, it is an object of the present invention to provide such a hat hanger, which will be relatively easy and inexpensive to manufacture from a minimum of material, and which will be rugged and durable in use.

Briefly, these objects are achieved by a hat hanger according to the present invention, wherein a hook suspends a hanger comprised by a cross member terminating at its ends in two downwardly depending forward legs. At their upper ends, the legs are joined by rearwardly extending bars which in turn terminate at their rear ends in downwardly depending legs parallel to the first-mentioned legs apart from rearwardly extending bends intermediate their length for keeping the hat spaced from a wall against which the bends bear. These latter or rear legs terminate downwardly in a forwardly extending loop which fits inside the hat and provides the principal support for the hat.

Figure 1:
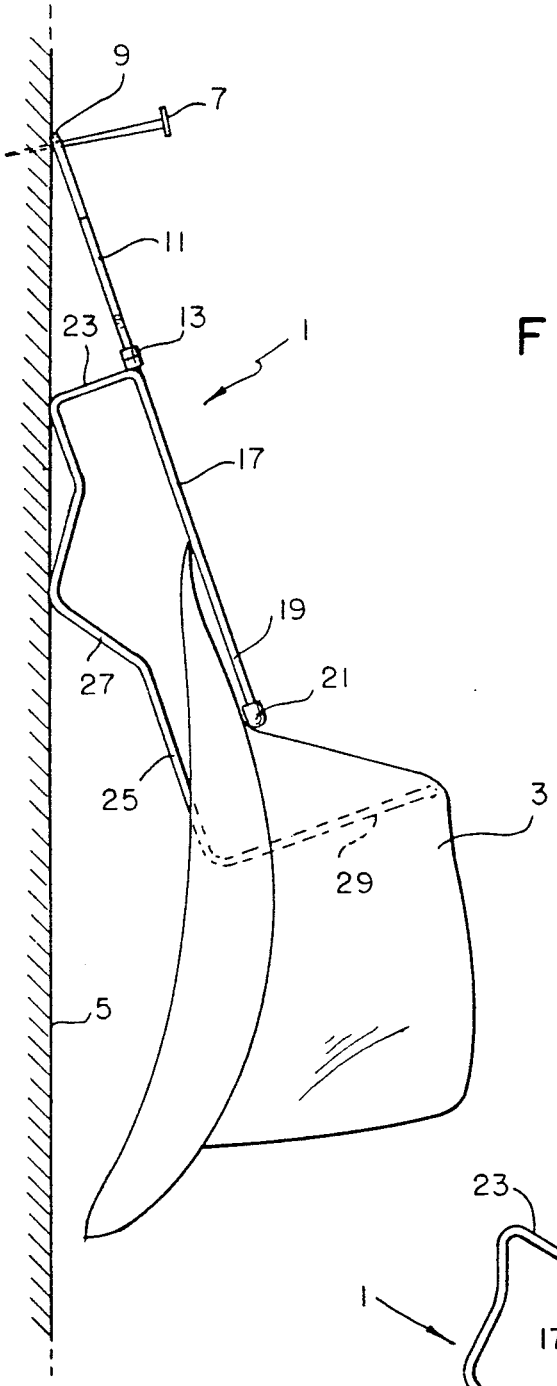
Figure 2:
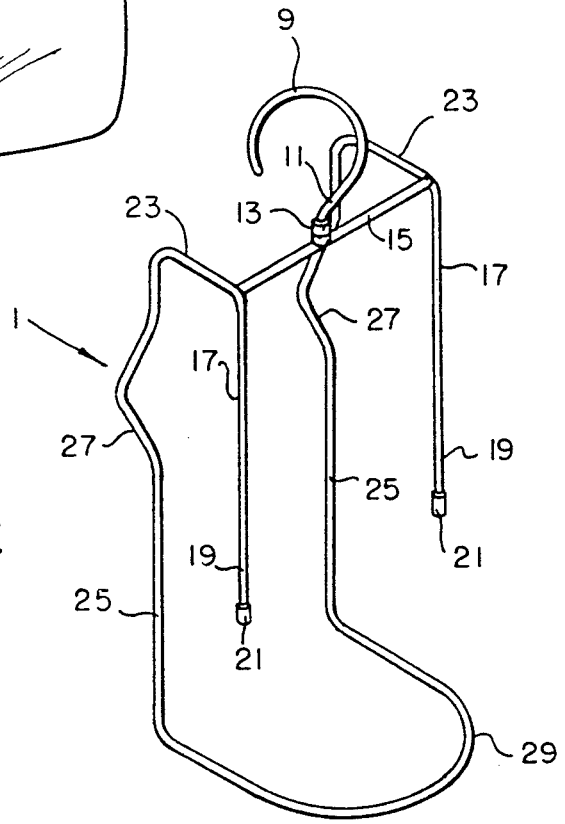

Other objects, features and advantages of the present invention will become apparent from a consideration of the following description, taken in connection with the accompanying drawing, in which:

FIG. 1 is a side elevational view of a hat hanger according to the present invention, in use to support a western or cowboy hat from a hook on a wall; and FIG. 2 is an enlarged perspective view of the hat hanger itself.

Referring now to the drawing in greater detail, there is shown a hat hanger according to the present invention, indicated generally at 1, for supporting a large hat 3 in the nature of a western or cowboy hat from a wall 5 or other support without damaging or misshaping the hat. A hook or nail 7 driven or screwed into wall 5 supports hanger 1 from a hook 9 that terminates downwardly in a shank 11. Shank 11 is connected by a swivel 13 to a cross bar 15 of the hanger.

At its ends, cross bar 15 terminates in downwardly extending straight vertical legs 17, which at their lower free ends 19 are provided with protectors 21 such as rubber grommets, so that the free ends 19 do not damage the hat. Alternatively, free ends 19 could be interconnected by a further cross bar (not shown), in which case protectors 21 would not be needed.

Horizontal bars 23 extend rearwardly from the upper ends of legs 17 and the opposite ends of cross bar 15 and terminate at their rear ends in downwardly extending vertical legs 25 which are straight except for bends 27 intermediate their length. Bends 27 are provided by an upper downwardly and rearwardly extending portion and a lower downwardly and forwardly extending portion, and so are V-shaped in the illustrated embodiment. Of course, they could have another shape, for example, semi-circular, their purpose being, as shown in FIG. 1, to space the hanger and hence the hat a suitable distance from the wall 5.

At their lower ends, legs 25 terminate in a forwardly extending horizontal loop 29, which fits inside the hat and provides the principal support for the hat.

The hanger is illustrated as being bent and welded wire. Of course, it could instead be molded plastic. If wire, however, then it is preferred that cross bar 15 be a separate piece and that legs 17 and 25 and horizontal bars 23, as well as loop 29, be all bent from a single length of steel wire. It is also preferred that cross bar 15 be welded at its ends to that single length of steel wire.

The use of the hanger of the present invention is best seen in FIG. 1. Upon removing the hat, the user will insert the brim upwardly between legs 17 and 25, whereupon loop 29 will enter the hat and, upon release of the hat, will support the hat in the position shown in FIG. 1, in which the hat touches only the hanger 1 and not the wall 5.

Removal of the hat from the hanger is of course in the opposite direction.

In view of the foregoing disclosure, therefore, it will be evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A hat hanger comprising a hook, a crosspiece suspended by its middle from said hook, the crosspiece having ends from which depend a first pair of downwardly extending forward legs, a second pair of downwardly extending rear legs supported by said ends of said crosspiece and disposed behind said first downwardly extending legs, said second downwardly extending legs having rearwardly extending bends intermediate their length, said second downwardly extending legs terminating downwardly in a forwardly extending loop interconnecting lower ends of said second downwardly extending legs.

2. A hat hanger as claimed in claim 1, said hook being swivelly connected to said crosspiece for horizontal swinging movement of said crosspiece relative to said hook.

3. A hat hanger as claimed in claim 1, said first downwardly extending legs terminating downwardly in free ends.

4. A hat hanger as claimed in claim 3, and enlarged protectors on said free ends to protect a hat against damage from said free ends.

5. A hat hanger as claimed in claim 1, which is of bent wire, said first and second legs and said loop being of a single piece of wire and said cross bar being welded at its ends to said single piece of wire.

6. A hat hanger as claimed in claim 1, and bars extending rearwardly from said ends of said crosspiece, said bars having rear ends from which depend said second downwardly extending rear legs.

* * * * *